US008820549B1

(12) United States Patent
Estrada

(10) Patent No.: US 8,820,549 B1
(45) Date of Patent: Sep. 2, 2014

(54) MULTI-CHAMBER NURSING BOTTLE HAVING FRANGIBLE PORTION FOR SEPARATELY STORING LIQUIDS AND OTHER SUBSTANCES

(76) Inventor: Christopher Estrada, Houston, TX (US)

( * ) Notice: Subject to any disclaimer, the term of this patent is extended or adjusted under 35 U.S.C. 154(b) by 352 days.

(21) Appl. No.: 13/298,330

(22) Filed: Nov. 17, 2011

(51) Int. Cl.
*B65D 1/04* (2006.01)

(52) U.S. Cl.
USPC ..... 215/6; 215/11.3; 215/11.4; 215/11.6; 215/48

(58) Field of Classification Search
USPC ..... 215/6, 11.1–11.6, 48, 227, 228, 250, 215/277, 307–311, 313, 314, 321; 220/502; 426/117
See application file for complete search history.

(56) References Cited

U.S. PATENT DOCUMENTS

| | | | | |
|---|---|---|---|---|
| 1,667,818 | A * | 5/1928 | Page | 222/144.5 |
| 1,896,976 | A * | 2/1933 | Schifferdecker | 220/253 |
| 2,885,104 | A * | 5/1959 | Greenspan | 206/222 |
| 3,144,152 | A * | 8/1964 | Kopp | 215/6 |
| 4,779,722 | A * | 10/1988 | Hall | 206/221 |
| 4,856,995 | A * | 8/1989 | Wagner | 433/215 |
| 4,979,629 | A * | 12/1990 | Askerneese | 215/11.1 |
| 5,419,445 | A * | 5/1995 | Kaesemeyer | 215/11.1 |
| 5,433,328 | A * | 7/1995 | Baron et al. | 215/11.4 |
| 5,588,561 | A * | 12/1996 | Ness | 222/129 |
| 5,593,052 | A * | 1/1997 | McGee | 215/11.1 |
| 5,758,786 | A * | 6/1998 | John | 215/6 |
| 5,921,440 | A * | 7/1999 | Maines | 222/145.2 |
| 5,944,709 | A | 8/1999 | Barney et al. | |
| 6,257,428 | B1 * | 7/2001 | Caola | 215/11.1 |
| 6,446,822 | B1 * | 9/2002 | Meyers et al. | 215/11.5 |
| 6,601,720 | B2 * | 8/2003 | Meyers et al. | 215/11.5 |
| 6,820,767 | B2 * | 11/2004 | Nicholas | 222/144.5 |
| 7,036,975 | B2 * | 5/2006 | Renz | 366/130 |
| D532,298 | S * | 11/2006 | Vogel | D9/447 |
| 7,331,478 | B2 * | 2/2008 | Aljadi | 215/11.4 |
| 7,484,633 | B1 * | 2/2009 | Moher | 215/11.1 |
| 7,810,661 | B2 * | 10/2010 | Murphy | 215/11.1 |
| 7,832,576 | B2 | 11/2010 | Chn | |
| 7,850,027 | B2 * | 12/2010 | Hayes et al. | 215/11.4 |
| 8,123,057 | B2 * | 2/2012 | Kunz et al. | 215/216 |
| 8,556,094 | B2 * | 10/2013 | Brown et al. | 215/11.4 |
| 2006/0078656 | A1 | 4/2006 | Manning et al. | |
| 2006/0093765 | A1 | 5/2006 | Mueller | |
| 2007/0017890 | A1 * | 1/2007 | Al-Jadh | 215/11.1 |
| 2007/0029001 | A1 | 2/2007 | Trouilly et al. | |
| 2007/0278174 | A1 * | 12/2007 | Kunz et al. | 215/224 |
| 2008/0156763 | A1 * | 7/2008 | Murphy | 215/11.1 |
| 2009/0178940 | A1 * | 7/2009 | Said | 206/221 |
| 2011/0120900 | A1 * | 5/2011 | Nahum | 206/524.1 |
| 2012/0193317 | A1 * | 8/2012 | Brown et al. | 215/6 |

* cited by examiner

*Primary Examiner* — Anthony Stashick
*Assistant Examiner* — Ned A Walker
(74) *Attorney, Agent, or Firm* — Michael Diaz

(57) ABSTRACT

A multi-chamber beverage container. The container includes an insert having an opening. The insert also includes a first chamber containing a first set of contents and a second chamber containing a second set of contents. The first and second chambers are separated by a frangible seal. The frangible seal is ruptured to mix the first set of contents with the second set of contents in an interior of the insert. In one embodiment, the present invention includes a container shell to house the insert. The insert may also include a cap that accommodates a nipple assembly.

3 Claims, 8 Drawing Sheets

MULTI-CHAMBER NURSING BOTTLE HAVING FRANGIBLE PORTION FOR SEPARATELY STORING LIQUIDS AND OTHER SUBSTANCES

BACKGROUND OF THE INVENTION

1. Field of the Invention

This invention relates to containers. Specifically, and not by way of limitation, the present invention relates to a multi-chamber container for separately storing liquids and other reconstitutable materials in a single insert.

2. Description of the Related Art

There are many instances where someone needs to have access to fluids, especially when the individual travels outside of a residence. In particular, it is quite common for parents to carry fluids for use by infants or young children, such as infant formula stored in a baby bottle. Infant formula is a manufactured food designed and marketed for feeding to babies and infants under 12 months of age, usually prepared for bottle-feeding or cup-feeding from powder (mixed with water) or liquid (with or without additional water). Oftentimes, pre-mixed store bought formulations are not desired because of formulation modifications for the purpose of preserving the liquid that are either less palatable or irritable to an infant's sensitive alimentary canal. Typically, the powder of infant formula is stored separately from the water or liquid. The powder is typically stored separately because once the infant formula is mixed with water, the mixed formula has a limited time of use prior to spoiling or losing nutritional value in the formula. The parent either carries the powder in a separate container from the liquid or carries the powder alone and uses water from another source. Outside of the residence, the options for clean, potable water are dubious, with oftentimes the only option being potentially contaminated water fountains or restroom faucets. The infant formula powder is carried separately from the liquid to retain the freshness of the infant formula. Thus, to insure a safe mixture is provided to the infant, the parents do not mix the product until absolutely necessary.

However, the scheme of carrying powder or liquid separately from water comes with several disadvantages. First, the process of mixing the powder with a fluid is cumbersome. Oftentimes, the powder must be poured into a bottle. In such a case, the parent often has trouble easily pouring the powder into a narrow opening at the top of the container, i.e., baby bottle. Secondly, powder storage is often messy. Third, ambient temperature and humidity alter the powder chemistry if the container used to store the powder is not properly vacuum sealed. Fourth, reconstituting the unit may be inaccurate without an appropriate measuring apparatus. In addition, it is often difficult to store a fluid, such as water, without leaking or spilling the water.

Although there are no known prior art teachings of an apparatus such as that disclosed herein, a prior art reference that discusses subject matter that bears some relation to matters discussed herein is U.S. Patent Application Publication No. 2006/0078656 to Manning et al. (Manning). Manning discloses a baby bottle liner having a premeasured amount of sterilized powdered infant formula. However, Manning does not include separately stored contents in a multi-chamber configuration. Manning suffers from the disadvantage of requiring the cumbersome task of adding water or other liquid to the liner.

Thus, it would be advantageous to have an apparatus enabling a person to separate store different types of ingredients while enabling the mixing of the separate stored ingredients when desired. Thus, it is an object of the present invention to provide such an apparatus.

SUMMARY OF THE INVENTION

In one aspect, the present invention is directed to a multi-chamber beverage container. The container includes an insert having an opening. The insert also includes a first chamber containing a first set of contents and a second chamber containing a second set of contents. The first and second chambers are separated by a frangible seal. The frangible seal is ruptured to mix the first set of contents with the second set of contents in an interior of the insert. In one embodiment, the present invention includes a container shell to house the insert. The insert may also include a cap that accommodates a nipple assembly.

In another aspect, the present invention is directed to a method of using a multi-chamber beverage container. The method begins by placing a first set of contents in a first chamber and a second set of contents in a second chamber. The first chamber is separated from the second chamber by a frangible seal. Next, the insert is physically manipulated to rupture frangible seal and mix the first set of contents with the second set of contents.

DESCRIPTION OF THE INVENTION

Figure 1:
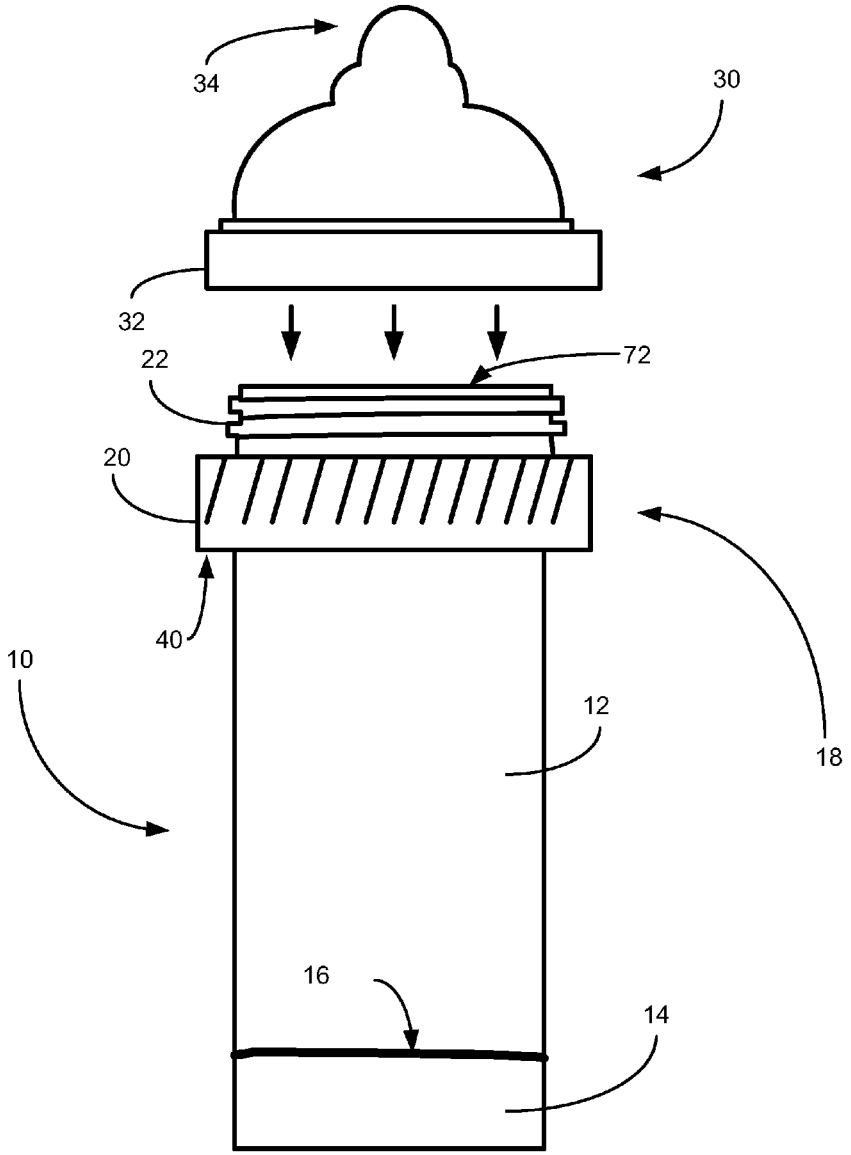
FIG. 1 is a front view of a multi-chamber insert in one embodiment of the present invention.

The present invention is a multi-chamber container for storing and mixing separate ingredients. FIG. 1 is a front view of a multi-chamber insert 10 in one embodiment of the present invention. The insert is preferably constructed of a polyvinyl material or other similar material which retains liquid and is flexible. The insert includes an upper chamber 12 and a separate lower chamber 14. The chambers 12 and 14 are preferably divided by a frangible seal 16. On an upper portion 18 of the insert 10 is a rim 20. The rim is preferably constructed of a rigid material, such as a hard plastic. The rim may include a threaded circumference 22. The rim may include a threaded underside 40 on the rim.

In addition, the present invention may include a cap 30 having a threaded inner rim (not shown) on an inner side of a rim 32 of the cap 30. The cap may include a nipple assembly 34 commonly found on many infant bottles. The nipple assembly may be constructed of a malleable plastic or other material sized and shaped for use by an infant or baby. The cap may be screwed onto the rim 20 of the insert 10 by threading the threaded circumference 22 of the rim 20 to a threaded underside (not shown) of the rim 32.

Figure 8:
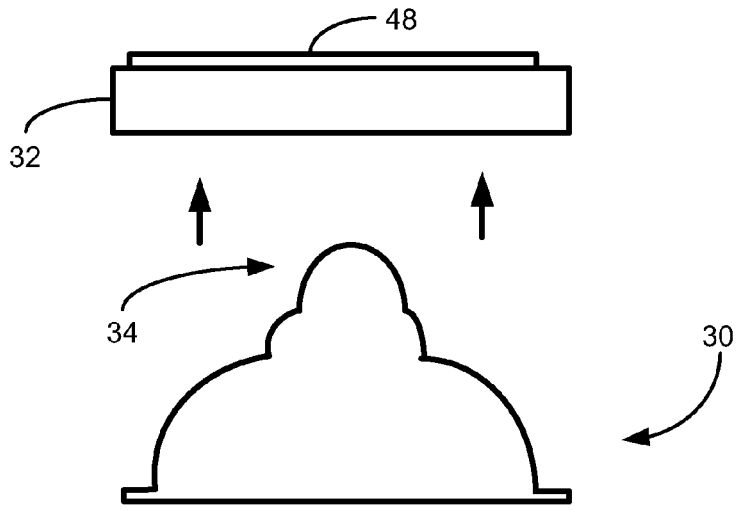
FIG. 8 is a side view of the cap with the nipple assembly separate from the rim in one embodiment of the present invention.

In one embodiment, the nipple assembly and rim may be separate components. FIG. 8 is a side view of the cap 30 with the nipple assembly separate from the rim 32. The rim may include an opening 48 to allow the contents to flow through the rim to the nipple assembly. The nipple assembly may be replaced by another dispensing apparatus, such as found on drinking devices for toddlers allowing sipping by the toddler.

Figure 2:
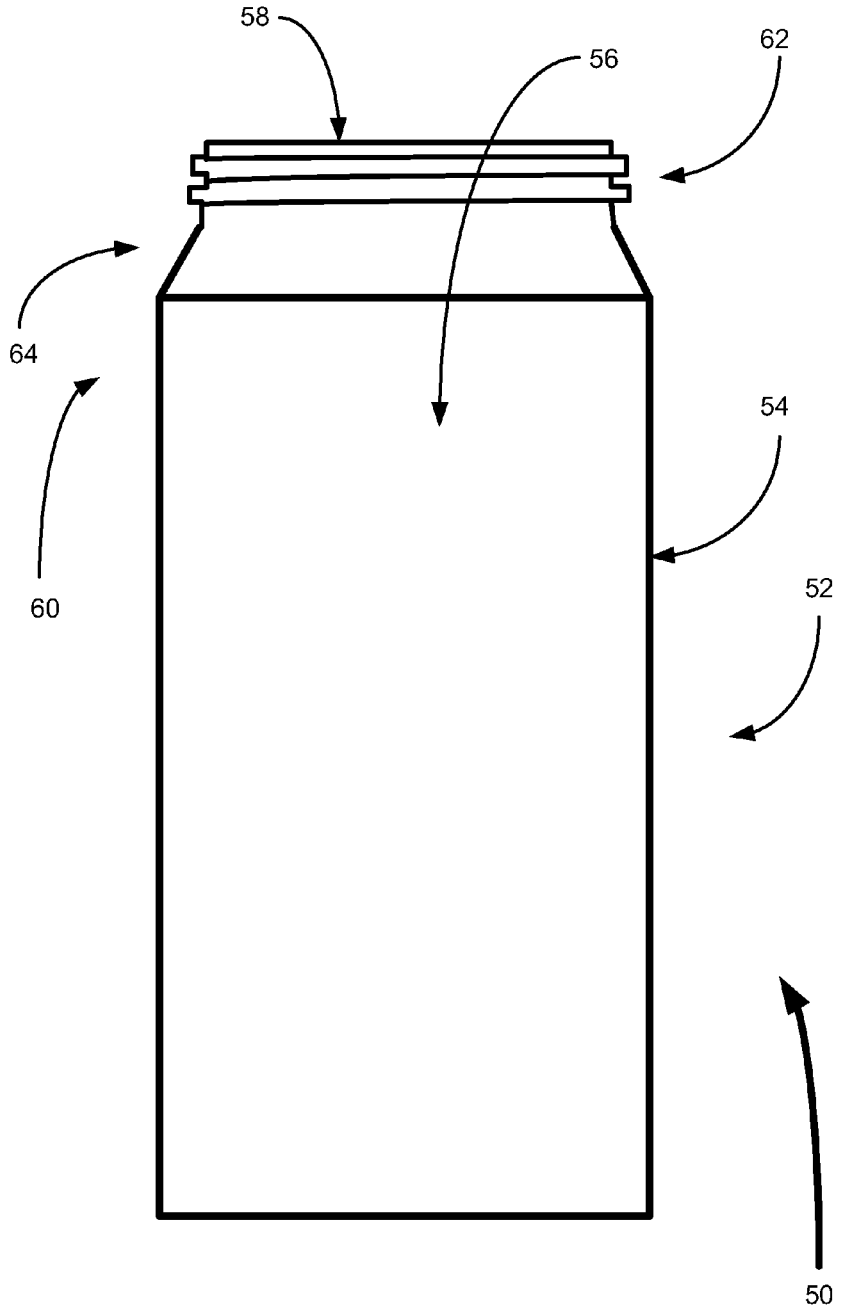
FIG. 2 is a front view of a container shell.

FIG. 2 is a front view of a container shell 50. The container shell 50 may be utilized to house or store the insert 10. The container shell is sized and shaped to include a main body 52 having an outer surface 54 having an interior 56 to accommodate the insert 10. The container shell 50 includes an opening 58 at an upper end 60 for insertion of the insert 10 within the interior 56. In addition, the container shell may include a threaded rim 62 for coupling with the underside of the rim 20 at a tapered portion 64. In the preferred embodiment of the present invention, the container shell 50 is constructed of a rigid material, such as a hard plastic.

Figure 3:
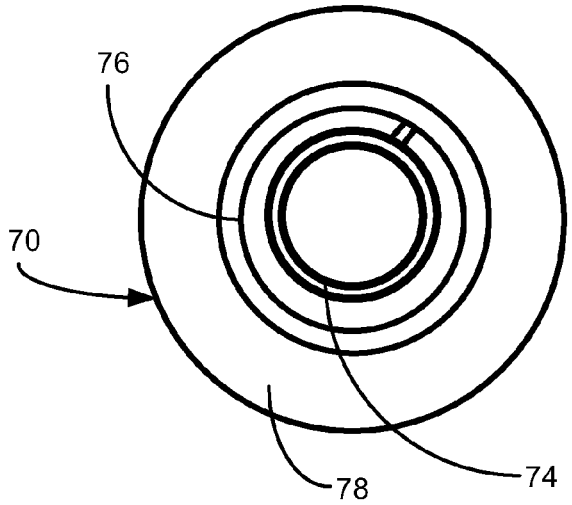
FIG. 3 is a top view of a removable cover for covering an opening of the upper portion of the insert.

FIG. 3 is a top view of a removable cover 70 for covering an opening 72 of the upper portion 18 of the insert 10. The removable cover may include a mechanism to allow easy removal of the cover 70 from the insert. In one embodiment, as depicted in FIG. 3, the cover includes a pull ring 74 attached to a coil 76 affixed to a top surface 78 of the cover. The cover is attached to the top of the insert to prevent the contents of the insert 10 from exiting the opening 72. The user may pull the pull ring 74 to remove the cover 70 from the insert 10.

Figure 4:
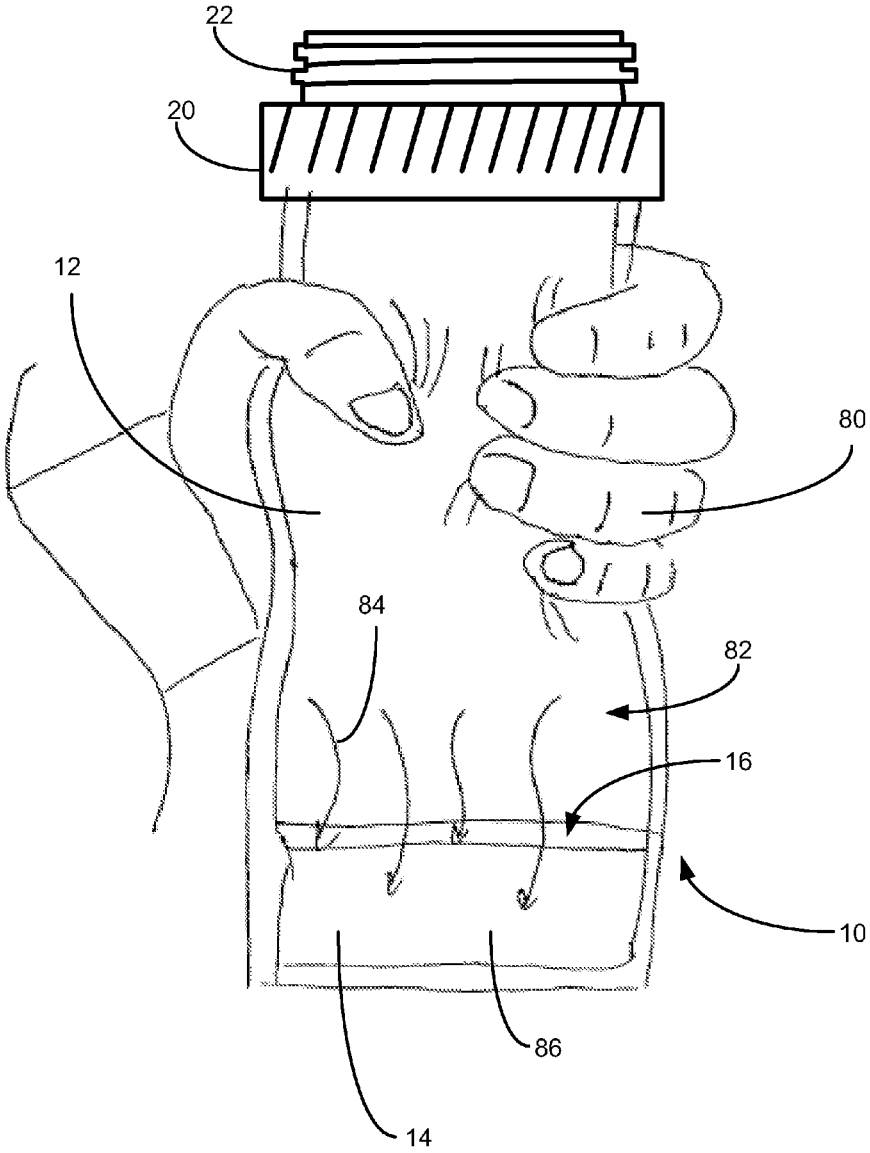
FIG. 4 is a front view of a user's hand squeezing the insert.

FIG. 4 is a front view of a user's hand 80 squeezing the insert 10. The user may exert pressure on an outer surface 82 of the insert, thereby forcing contents 84 (e.g., a liquid such as water) contained in the upper chamber 12 to flow downward, breaking the frangible seal 16, and entering the lower chamber 14. When the contents 84 enter the lower chamber, the contents 84 are mixed with contents 86 (e.g., powder such as baby formula powder).

Figure 5:
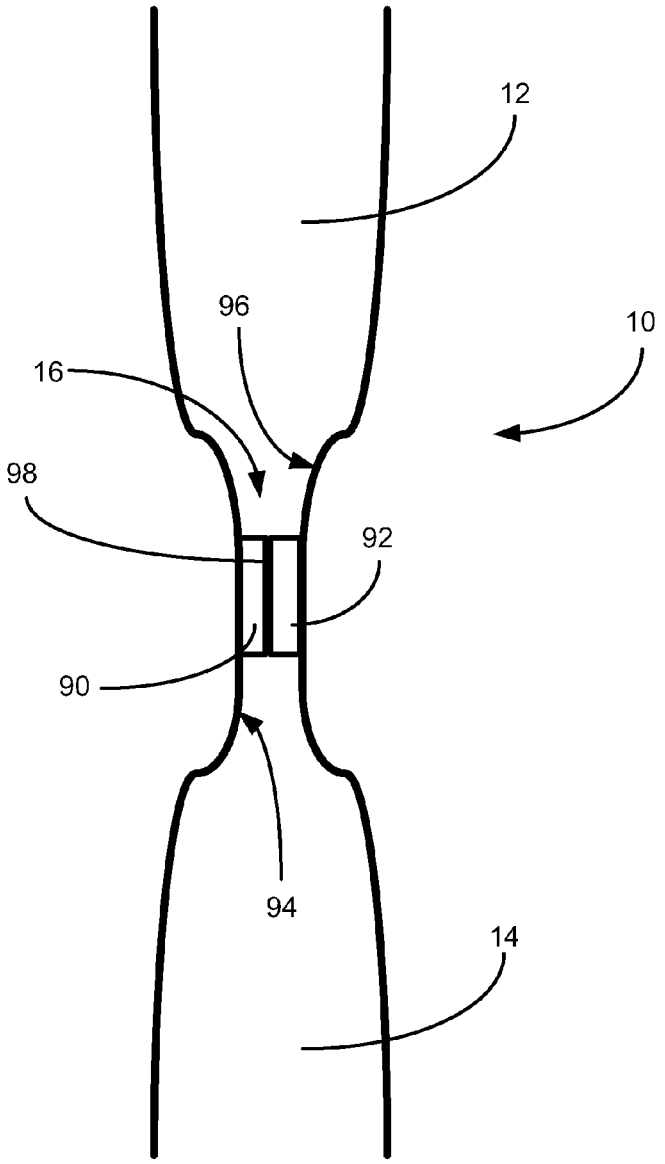
FIG. 5 is an enlarged side view of the frangible seal of the insert of FIG. 1.

FIG. 5 is an enlarged side view of the frangible seal 16 of the insert 10 of FIG. 1. The insert includes the frangible seal enabling the contents 84 in the upper chamber 12 to be separated from the contents 86 located in the lower chamber 14. The frangible seal may be any mechanism which enables the separation of the contents of the upper and lower chambers while still allowing the contents to be mixed by exerting pressure on the insert. In one embodiment illustrated in FIG. 5, the frangible seal includes two thermoplastic strips 90 and 92 positioned on opposing inner walls 94 and 96 of the insert. The strips are adapted to form stronger bonds with the corresponding inner walls than with a seal 98 between the two thermoplastic strips. In particular, there is a non-frangible bond between the strips and the corresponding inner walls. Thus, the frangible seal may be broken by providing force on the outer surface of the insert. The thermoplastic strips are detachably attached at the seal 98. In one embodiment, the frangible seal is formed from a partial melting together of the strips 90 and 92. It should be understood that the strips may be varied in position and number and still remain in the scope of the present invention. Although preferably constructed of a thermoplastic material, the strips may be constructed of any material providing a closeable opening or seal.

Figure 6:
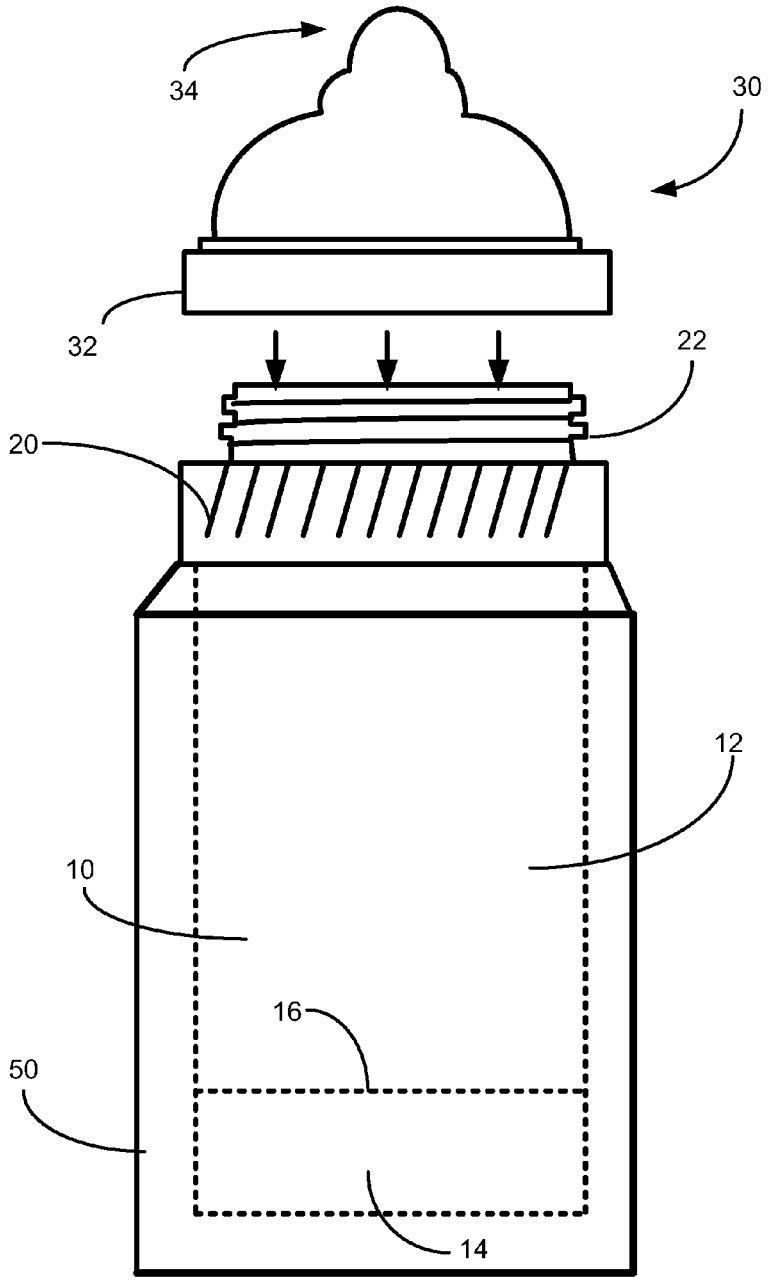
FIG. 6 is a side view of the insert positioned within the container shell in one embodiment of the present invention.

FIG. 6 is a side view of the insert 10 positioned within the container shell 50 in one embodiment of the present invention. After mixing the contents (e.g., contents 84 and contents 86 within the interior of the insert 10, the insert may be positioned through the opening 58 and into the interior 56 of the container shell 50. The rim 62 is threaded to the threaded underside 40 of the rim 20 to fasten the insert to the container shell 50. When desired, the pull ring 74 may be pulled and the cover 70 removed from the insert 10. The cap 30 may optionally be threaded on to the threaded circumference 22. The present invention may then be utilized for dispensing the mixed contents of the insert 10 through the nipple assembly 34.

With reference to FIGS. 1-6, the operation of the present invention will now be explained. Separate types of contents are stored in separate chambers in the insert. For example, liquid may be stored in the upper chamber 12 while powder or other ingredient (such as infant formula) is stored in the lower chamber 14. The ingredients of the upper and lower chamber are separated by the frangible seal 16. The insert may include the cover 70 covering the opening 72 of the insert. The contents of the upper and lower chambers remain separated until consumption of the contents is desired by the user. In one embodiment, liquid, such as water is stored in the upper chamber 12. The user may desire to only use or consume the contents of the upper chamber 12 without mixing with the contents of the lower chamber 14. In such a situation, the insert is not manipulated by the user to break the seal. The cover 70 is removed and the contents of the upper chamber are consumer, either through the opening 72 or through the nipple assembly 34. Thus, the user may access the contents of the upper chamber, such as water, without mixing with the contents of the lower chamber.

If the user desires to mix the contents of the lower chamber 14 with the contents of the upper chamber 12, the user may physically manipulate the insert 10 to rupture the frangible seal 16, thereby allowing the contents of the upper chamber 12 to mix with the contents of the lower chamber 14. The user may remove the cover 70 by pulling on the pull ring 74 and removing the cover from the upper portion 18 of the insert 10. The user may optionally pass the insert 10 through the opening 58 and position the insert within the interior 56 of the container shell 50. The insert may be attached to the container shell by threading the threaded underside 40 of the rim 20 with the threaded rim 62 of the container shell. The cap 30 may be attached to the upper portion 18 of the insert by threading an underside of the rim 32 of the cap 30 with the threaded circumference 22 of the insert 10. In this configuration, as shown in FIG. 6, the person drinking (e.g., infant) may suck through the nipple assembly 34. After use, the insert 10 may be removed from the container shell 50 and discarded as desired by the user.

In one embodiment, the insert may include a foil outer surface for one or both chambers to protect against direct sunlight to the contents of the insert, which may be susceptible to damage or reduced usability when exposed to sunlight. For example, in one embodiment, one or both chambers may be constructed or lined with a material that has a certain degree of opacity, thereby preventing the contents of the container from photo-degradation. Although in one embodiment, a liquid is housed in the upper chamber and a powder or liquid concentrate in the lower chamber, each chamber may contain a liquid or solid and still remain in the scope of the present invention. Furthermore, although a nipple assembly 34 is depicted in the illustrations, the present invention may include any top assembly which allows ease in drinking, such as a pull up top common for many sports drinks. In an alternate embodiment, the present invention includes more than two chambers, which may be aligned vertically or horizontally.

If used as an infant feeding system, the insert serves the additional function of a "bottle liner" whose benefits allow minimal entrainment of air to the gastrointestinal tract during consumption as well as providing a gravity driven dispersement of fluid that more closely resembles breast feeding.

Figure 7:
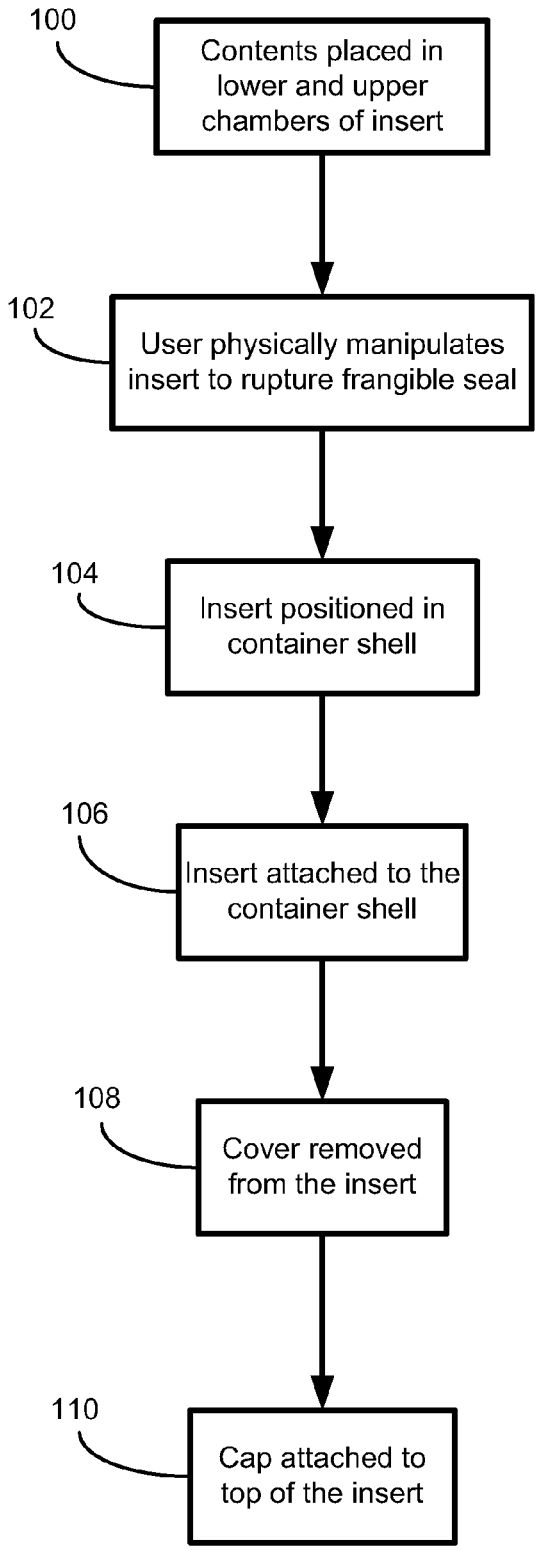
FIG. 7 is a flow chart illustrating the steps of a method of using the insert.

FIG. 7 is a flow chart illustrating the steps of a method of using the insert 10 according to the teachings of the present invention. With reference to FIGS. 1-7, the method will now be explained. The method begins with step 100 where separate contents are placed in the upper chamber 12 and the lower chamber 14. In the preferred embodiment of the present invention, the contents are placed in the separate chambers during the manufacturing process. For example, liquid may be stored in the upper chamber 12 while powder or another ingredient, such as infant formula, is stored in the lower chamber 14. The ingredients of the upper and lower chambers are separated by the frangible seal 16. The opening 72 of the insert 10 may be closed by the cover 70. The contents of the upper and lower chambers remain separated until consumption of the contents is desired by the user. However, the user may desire to only consume the contents of the upper chamber 12 without mixing with the contents of the lower chamber 14. In such a situation, the insert is not manipulated by the user to break the seal. The cover 70 is removed and the contents of the upper chamber (e.g., water) are consumed, either through the opening 72 or through the nipple assembly 34. Thus, the user may access the contents of the upper chamber, such as water, without mixing with the contents of the lower chamber. However, if the user desires to mix the contents of the lower chamber 14 with the contents of the upper chamber 12, in step 102, the user physically manipulates the insert 10 to rupture the frangible seal 16, thereby allowing the contents of the upper chamber 12 to mix with the contents of the lower chamber 14. In step 104, the user optionally positions the insert within the interior 56 of the container shell 50. In step 106, the insert may be attached to the container shell by threading an underside threaded portion at 40 of the rim 20 with the threaded rim 62 of the container shell. Next, in step 108, the user may remove the cover 70 by pulling on the pull ring 74 and removing the cover from the upper portion 18 of the insert 10. In step 110, the cap 30 may be attached to the upper portion 18 of the insert by threading an underside of the rim 32 of the cap 30 with threaded circumference 22 of the insert 10. In this configuration, as shown in FIG. 6, the person drinking (e.g., infant) may suck through the nipple assembly 34. After use, the insert 10 may be removed from the container shell 50 and discarded as desired by the user.

The present invention provides many advantages over existing beverage containers. The present invention provides a container which stores two or more contents separately and sterilely. At times, when the contents are mixed, the user only has a limited amount of time to consume the mixed contents without spoiling or losing its full nutritional value. Thus, the mixing process must be postponed until the user is ready to consume the contents. The present invention provides an apparatus which enables ease in storing and transporting separate contents while still allowing the user the ability to easily mix the contents when desired. In addition, the present invention provides an insert which may be coupled to a container shell for ease in consumption, especially for an infant. Furthermore, when designed as a bottle liner, the insert supports the additional function of minimizing the amount of air entrained into the gastrointestinal tract during consumption, thereby minimizing gas bloat discomfort.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A multi-chamber beverage container, the container comprising:

an insert comprising:

an opening;

a threaded rim on an upper portion of the insert;

a first chamber and a second chamber separated by a frangible seal, the frangible seal including at least two thermoplastic strips affixed to opposing interior walls of the insert;

a removable cover covering an opening of the insert, the cover including a pull ring for removing the cover from the opening of the insert wherein the first chamber contains a first set of contents and the second chamber contains a second set of contents;

means for breaking the frangible seal to mix the first set of contents with the second set of contents in an interior of the insert;

a container shell housing the insert within an interior of the container shell, the container shell comprising:

an opening for insertion of the insert into the interior; and, means for coupling the insert to the container shell;

a nipple assembly; and, a cap accommodating the nipple assembly and having means for fastening to the threaded rim of the insert and covering the opening of the insert.

2. The multi-chamber beverage container according to claim 1 wherein the first chamber is aligned above the second chamber.

3. The multi-chamber beverage container according to claim 1 wherein the first chamber includes a material for protecting the first set of contents from direct sunlight.

* * * * *